US009370703B1

(12) United States Patent
Lee

(10) Patent No.: US 9,370,703 B1
(45) Date of Patent: Jun. 21, 2016

(54) GOLF SWING CORRECTION APPARATUS USING THE MOMENT OF INERTIA

(71) Applicant: Sung Hyuk Lee, Seoul (KR)

(72) Inventor: Sung Hyuk Lee, Seoul (KR)

( * ) Notice: Subject to any disclaimer, the term of this patent is extended or adjusted under 35 U.S.C. 154(b) by 0 days.

(21) Appl. No.: 14/922,223

(22) Filed: Oct. 26, 2015

(30) Foreign Application Priority Data

Apr. 1, 2015 (KR) ..... 20-2015-0002058 U

(51) Int. Cl.
*A63B 69/36* (2006.01)
*A63B 69/00* (2006.01)

(52) U.S. Cl.
CPC ..... *A63B 69/0059* (2013.01); *A63B 69/3608* (2013.01); *A63B 2208/0204* (2013.01)

(58) Field of Classification Search
USPC ..... 473/212, 214, 219, 257
See application file for complete search history.

(56) References Cited

U.S. PATENT DOCUMENTS 802,623 A * 10/1905 Camp ..... A63B 69/0059 473/214
1,414,012 A * 4/1922 Flint ..... A63B 69/0059 2/255
2,468,580 A * 4/1949 Weis ..... A63B 69/0059 2/255
3,074,723 A * 1/1963 Esty ..... A63B 69/0059 128/881
3,658,345 A * 4/1972 Siggson ..... A63B 69/0059 473/214
3,990,709 A * 11/1976 DeRogatis ..... A61F 5/05858 473/214
4,504,054 A * 3/1985 Jackson ..... A63B 69/0059 473/214
5,425,539 A * 6/1995 Steffes ..... A63B 69/0059 473/214
5,445,385 A * 8/1995 Brooks ..... A63B 69/0059 473/214

FOREIGN PATENT DOCUMENTS

| | | |
|---|---|---|
| JP | 3127014 | 11/2006 |
| KR | 20-2009-0012493 | 12/2009 |
| KR | 10-2011-0106379 | 9/2011 |
| KR | 10-2012-0042000 | 5/2012 |
| KR | 20-0471280 | 2/2014 |

OTHER PUBLICATIONS

English Translation of 20-2009-0012493.
English Translation of 10-2011-0106379.
English Translation of 20-0471280.
English Translation of 10-2012-0042000.
English Translation of Abstract of 3127014.

* cited by examiner

*Primary Examiner* — Nini Legesse
(74) *Attorney, Agent, or Firm* — KORUS Patent, LLC; Seong Il Jeong

(57) ABSTRACT

The present invention relates to a golf swing correction apparatus using the moment of inertia in which a shoulder turn is improved by the moment of inertia of a swing which is not scattered and concentrated on the shoulder by the correction apparatus of a weight made to restrict a motion of a preceding arm during a swing of golf, accuracy of the impact is improved by preventing the preceding arm from bending to the follow-through for making a constant swing arc, and the carrying distance is increased by a muscular strength properly developed from the weight training, thereby properly correct a swing motion of golf.

6 Claims, 4 Drawing Sheets

GOLF SWING CORRECTION APPARATUS USING THE MOMENT OF INERTIA

CROSS-REFERENCE TO RELATED APPLICATION(S)

This application claims the benefit of Korean Patent Application No. 20-2015-0002058, filed on Apr. 1, 2015, which is hereby incorporated by reference herein in its entirety.

BACKGROUND

1. Technical Field

The present invention relates generally to a golf swing correction apparatus using the moment of inertia, and more particularly to a golf swing correction apparatus using the moment of inertia in which the moment of inertia is used for making a constant swing arc and improving shoulder turn which are important in golf swing; weights are distributed to maximize the moment of inertia by restricting a motion of arms to concentrate the moment of inertia on the shoulder turn when the golf club is turning on the axis of the human body; a constant size of the swing arc is made by preventing the preceding arms from bending to the follow-through during a swing, thereby improving accuracy of the impact; and the carrying distance is improved as well due to the muscular strength developed from the weight training.

2. Description of the Related Art

In general, golf is a club and ball sport in which a player holds and swings a club using a rotational movement of the upper body and lower body to thereby hit the ball to the target location.

Here, the swing motion in golf needs a natural turning motion of the shoulders from the address, which is a basic posture in golf, to the finish. The preceding elbow should not be bent before reaching the take-back, back-swing, down-swing, impact, and follow-through except for the finish, and especially in the follow-through, both elbows should not be bent and the club should be maintained in an outstretched state to the target location. All the above conditions are very important to improve the accuracy and carrying distance of the swing motion.

For these reasons, people traditionally used heavy clubs or weight rings attached to the clubs during a swing to improve the shoulder turn by inertia and to constantly make the swing arc large.

However, in this case, there is a problem that the size of the swing arc decreases due to the wrong movement in which both elbows are bent during back-swing when the weight of the club by the reaction could not be overcome. In addition, because of the bent elbow, the moment of inertia for rotating the shoulder becomes weak, thereby not allowing for effective follow-through in the shoulder turn. Accordingly, there is a problem of failing to improve the direction and carrying distance as is hoped by golf enthusiasts.

PRIOR ART DOCUMENT

[Patent Document 1] Korean Patent Application No. 10-2012-0042000

SUMMARY

Thus, the present invention is to solve the above problems, and the object of which is to provide a golf swing correction apparatus using the moment of inertia that is capable of improving swing correction, flexibility, and muscular strength.

Another object of the present invention is to provide a golf swing correction apparatus using the moment of inertia that is capable of improving the shoulder turn by the energy of the moment of inertia generated by the weight during a golf swing by mounting the weight on the arm and also greatly increasing the carrying distance by enhancing muscular strength developed by the weight.

Another object of the present invention is to provide a golf swing correction apparatus using the moment of inertia including an elbow support to improve accuracy of the impact by always keeping the arc at a predetermined size without the elbow being bent during a swing action of golf to the follow-through.

Another object of the present invention is to provide a golf swing correction apparatus using the moment of inertia which has a support allowing the elbow of a preceding arm to not be bent during the follow-through of a swing except for the finish to prevent the energy of the moment of inertia from decentralizing while the elbows become bent and to concentrate the energy to direct the shoulder turn.

Another object of the present invention is to provide a golf swing correction apparatus using the moment of inertia which has a support allowing the elbow to not be bent to improve the shoulder turn during a back-swing and to make a natural turning motion around the shoulder with the elbow straightened during a down-swing to maintain the are stretched by distributing the weight to the wrist side which is further away from the rotating axis of the body to generate the moment of inertia at a maximum during a swing.

Another object of the present invention is to provide a golf swing correction apparatus using the moment of inertia which can increase or decrease the weight of the correction apparatus or may distribute more weight to the wrist side which is farther away from the rotating axis than the shoulder side to adjust the size of the moment of inertia improving shoulder turn.

Another object of the present invention is to provide a golf swing correction apparatus using the moment of inertia in which the weight of the correction apparatus for allowing the elbow to not be bent is distributed such that half of the total weight is distributed on a ¼ position to the wrist side and the correction apparatus is formed to wrap the wrist to maintain the swing arc.

To achieve the above objects, the present invention provides a swing correction apparatus for extending a swing motion of golf, which comprises: a correction apparatus protector 102 for allowing an elbow to be outstretched without being bent, which includes a protector body 10 having a receiving unit 14 formed inside, a swing correction weight member 104 which is received in the receiving unit 14 of the correction apparatus protector 102 for stretching a swing arc by increasing the weight in the direction of a wrist during a swing motion to direct the weight to the outside of the radius of gyration during a turning motion of the arms and shoulders for a swing; and a connection fixing means 106 for wrapping and fixing the elbow when the correction apparatus protector 102 is worn on an arm, wherein the swing correction weight member 104 includes a base weight member 20 and a centrifugal weight member 22 and the centrifugal weight member 22 is formed such that a length (B) of the centrifugal weight member is shorter than a length (A) of the base weight member.

And, it is preferable that an insertion receiving unit 28 is formed inside of a lower part of the swing correction weight member and a weight adjustment weight member 30 is equipped in the insertion receiving unit 28.

It is preferable that a reception fixing unit 32 having a fixing groove 34 is formed on an upper side of a lower part of the swing correction weight member and a weight adjustment weight member 36 having a fixing protrusion 38 is inserted to be equipped in the reception fixing unit 32.

Furthermore, it is preferable that Velcro straps are attached on an upper side and a lower side of the swing correction weight member and each of the swing correction weight member and the weight adjustment weight member is attached and connected to the upper and lower sides.

It is preferable that a weight member band filled with sand or a weight member band filled with steel powder is formed on the protector body 10 for wrapping a wrist.

According to the golf swing correction apparatus using the moment of inertia according to the present invention, there are advantages in that: flexibility and muscular strength are enhanced to increase the carrying distance in golf, shoulder turn is improved by concentrating the moment of inertia generated by the weight during a swing, and accuracy of the impact is improved by maintaining a constant size of the swing arc since the swing motion is performed while the elbow is constantly straightened.

In addition, the present invention has an advantage in stretching the muscles of arms, shoulders, and the back, which are used in golf for turns by preventing the elbow from being bent by the weight and by the reaction using the moment of inertia during the turn, and the stretched muscles allow soft swings to prevent the injury and allow exercise for a long time.

Furthermore, the present invention has an advantage that the directional consistency is improved since a trajectory of the golf swing is maintained constantly due to the moment of inertia increased by the weight, which allows a user to quickly and easily learn to play golf.

DETAILED DESCRIPTION

Figure 1:
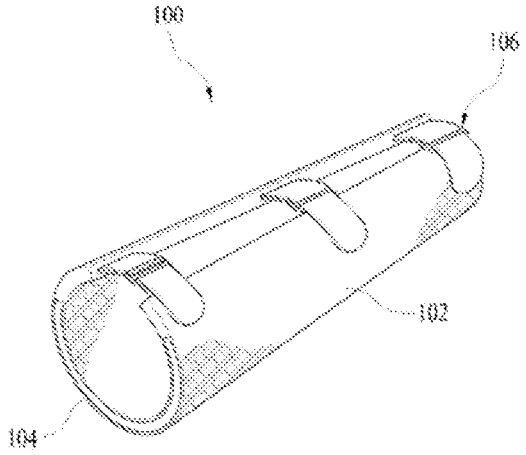
FIG. 1 is a perspective view showing a structure of a golf swing correction apparatus using the moment of inertia of the present invention.

The present invention relates to a swing correction apparatus for extending a swing motion in golf which comprises: a correction apparatus protector 102 for allowing an elbow to be outstretched without being bent, which includes a protector body 10 having a receiving unit 14 formed inside; a swing correction weight member 104 which is received in the receiving unit 14 of the correction apparatus protector 102 for stretching a swing arc by increasing the weight in the direction of the wrist during a swing motion to direct the weight to the outside of the radius of gyration during a turning motion of the arms and shoulders for a swing; and a connection fixing means 106 for wrapping and fixing the elbow when the correction apparatus protector 102 is worn on an arm, and it is preferable that the swing correction weight member 104 includes a base weight member 20 and a centrifugal weight member 22, the centrifugal weight member 22 is formed such that a length (B) of the centrifugal weight member is shorter than a length (A) of the base weight member, an insertion receiving unit 28 is formed inside of a lower part of the swing correction weight member, and a weight adjustment weight member 30 is equipped in the insertion receiving unit 28.

Now, a preferred embodiment of a golf swing correction apparatus using the moment of inertia according to the present invention is described.

Advantages and features of the present invention and methods of accomplishing the same will be apparent from the detailed description of exemplary embodiments with reference to the accompanying drawings.

However, the present invention may be embodied in many different forms and is not limited by the embodiments set forth herein. Rather, these embodiments are provided to complete the disclosure of the present invention and to fully convey the concept of the present invention to those skilled in the art pertinent to the present invention, and the present invention will be only defined by the appended claims.

Moreover, when the known technologies are determined to blur the essence of the present invention in describing the present invention, detailed description thereof will be omitted.

Rather, the embodiments introduced herein are intended to make this disclosure to be thorough and complete and fully convey the idea of the present invention to those skilled in the art.

The terms "first", "second", etc. will be used in describing various elements, but the elements are not limited to the above terms. These terms are only used to distinguish one element from the other. For example, without departing from the scope of the present invention, a first element could be named as a second element, and similarly, a second element could be named as a first element.

The terms "upper end", "lower end", "top surface", "bottom surface", "upper part", "lower part", and the like will be used to distinguish between the relative positions of the components. For example, when naming a top part of the drawing as an upper part and a bottom part of the drawing as a lower part for convenience, the upper part may be named as the lower part and the lower part may be named as the upper part in practice without departing from the scope of the present invention.

The terminology used herein is for the purpose of describing particular embodiments only and is not intended to be limiting the present invention. An expression of a singular form includes an expression of a plural form unless it is clearly defined otherwise in the context. In this application, the terms "comprise" or "have" is intended to designate that characteristics, numbers, steps, operations, elements, parts or combinations thereof are presented in the disclosure, and it should not be understood to preclude the presence or addition of any one or more of other features, numbers, steps, actions, components, or combinations thereof.

Unless defined otherwise, all terms, including technical or scientific terms, used herein have the same meaning as those terms are understood by those of ordinary skill in the art. General terms which are defined in a dictionary shall be construed in the same meaning in the context of the relevant art, unless otherwise defined explicitly, and it is not interpreted to have an idealistic or excessively formalistic meaning.

Hereinafter, a description of the present invention is provided with reference to a preferred embodiment applied to a golf swing correction apparatus using the moment of inertia with reference to the drawings, but the embodiments are not limited thereto. Rather, it should be noted in advance that a golf swing correction apparatus using the moment of inertia can be applied to a variety of uses and purposes when it is used.

Figure 2:
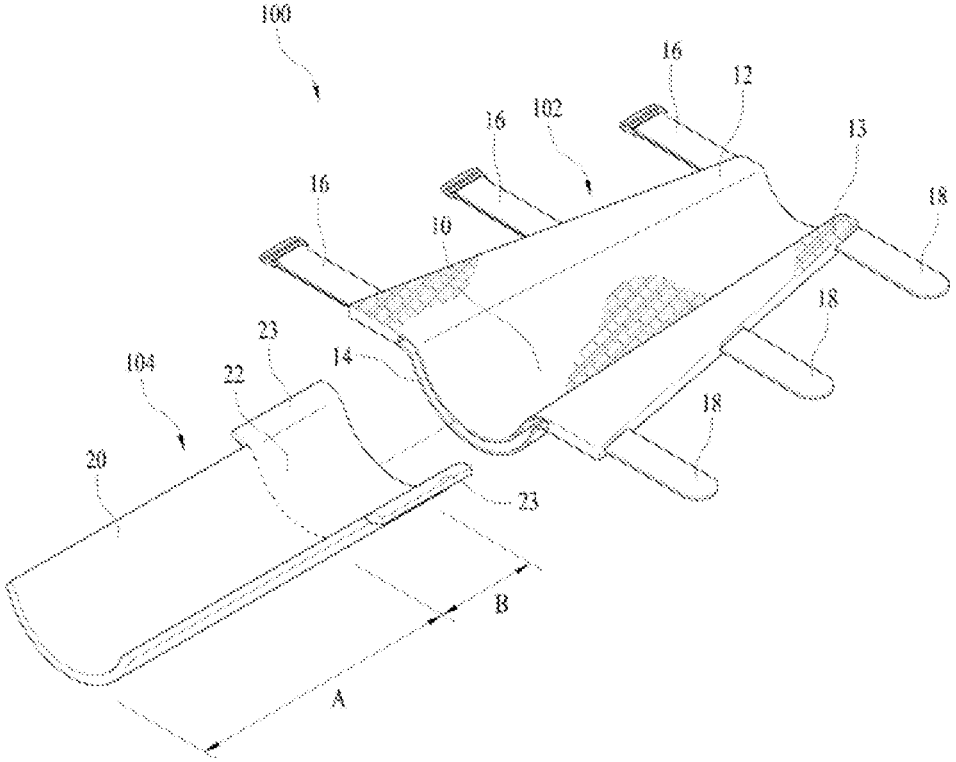
FIG. 2 is an exploded perspective view showing a structure of a golf swing correction apparatus using the moment of inertia of the present invention.
Figure 3:
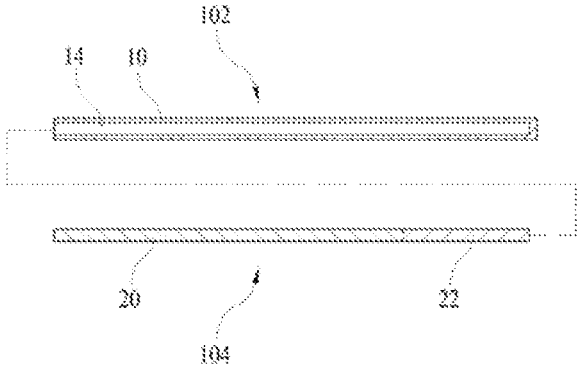
FIG. 3 is a sectional view of FIG. 1.

FIG. 1 is a perspective view showing a structure of a golf swing correction apparatus using the moment of inertia of the present invention, FIG. 2 is an exploded perspective view showing a structure of a golf swing correction apparatus using the moment of inertia of the present invention, and FIG. 3 is a sectional view of FIG. 1.

Figure 4:
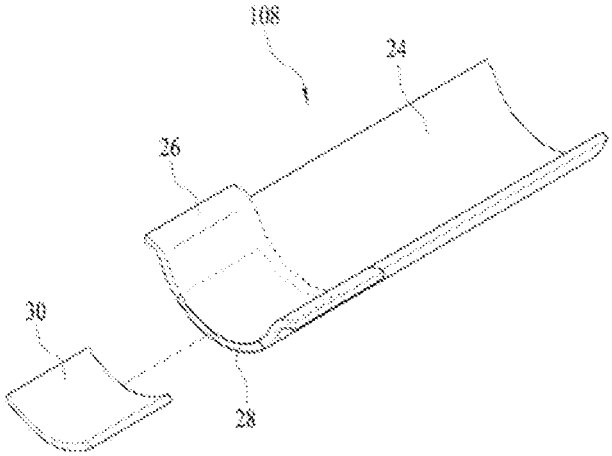
FIG. 4 is a perspective view showing a structure of a weight member of an embodiment of a golf swing correction apparatus using the moment of inertia of the present invention.
Figure 5:
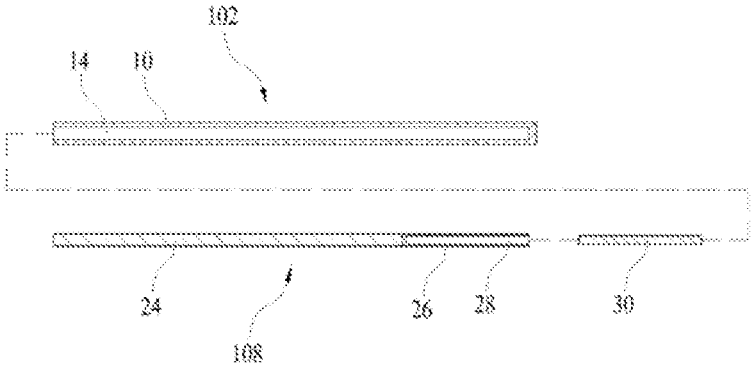
FIG. 5 is a sectional view of FIG. 4.
Figure 6:
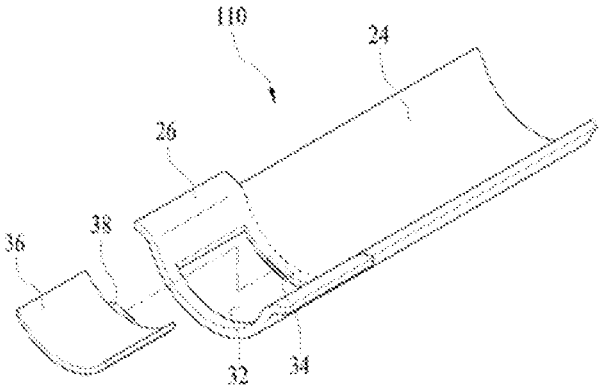
FIG. 6 is a perspective view showing a structure of a weight member of another embodiment of a golf swing correction apparatus using the moment of inertia of the present invention.
Figure 7:
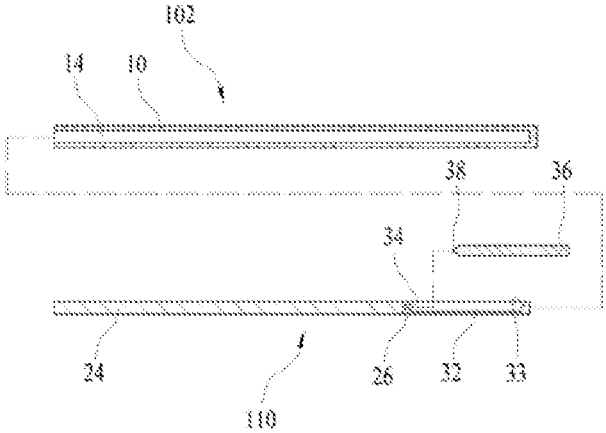
FIG. 7 is a sectional view of FIG. 6.

FIG. 4 is a perspective view showing a structure of a weight member of an embodiment of a golf swing correction apparatus using the moment of inertia of the present invention, FIG. 5 is a sectional view of FIG. 4, FIG. 6 is a perspective view showing a structure of a weight member of another embodiment of a golf swing correction apparatus using the moment of inertia of the present invention, and FIG. 7 is a sectional view of FIG. 6.

Figure 8:
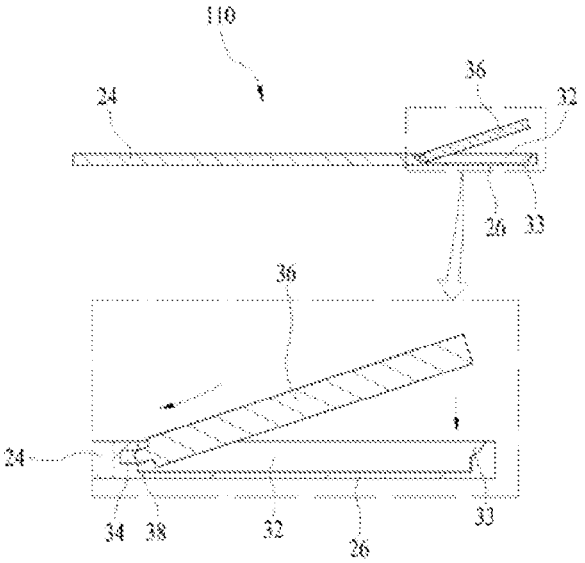
FIG. 8 is an enlarged sectional view showing a coupling state of FIG. 6.

In addition, FIG. 8 is an enlarged sectional view showing a coupling state of FIG. 6.

Figure 9:
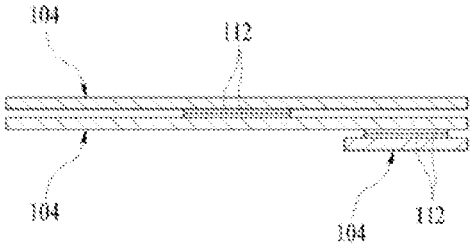
FIG. 9 is a perspective view showing a structure of another embodiment of a golf swing correction apparatus using the moment of inertia of the present invention.
Figure 10:
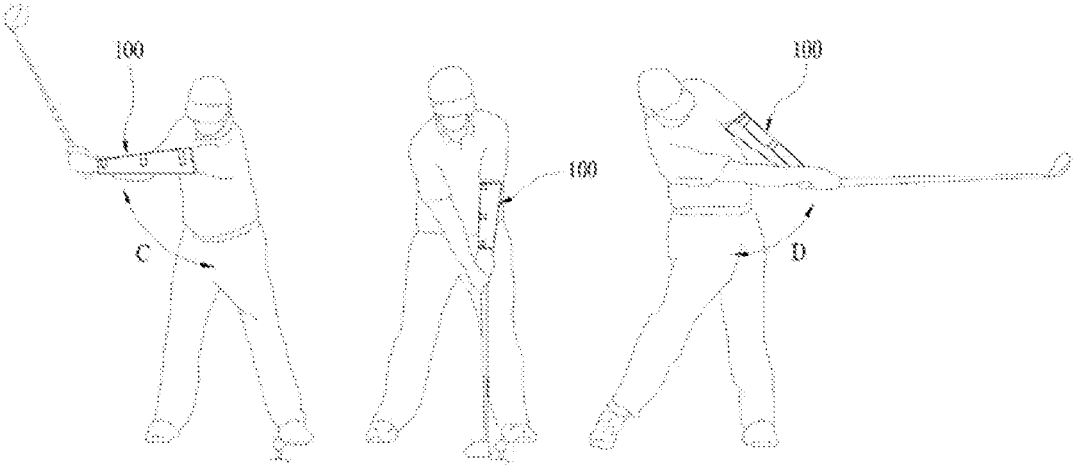
FIG. 10 is a perspective view showing a movement state using a golf swing correction apparatus using the moment of inertia of the present invention.

FIG. 9 is a perspective view showing a structure of another embodiment of a golf swing correction apparatus using the moment of inertia of the present invention, and FIG. 10 shows a movement state using a golf swing correction apparatus using the moment of inertia of the present invention.

FIGS. 1-10 illustrate only major characteristic parts clearly to help precise understanding of the present invention. Accordingly, it is expected that there might be various modifications in the explanatory diagram, and the scope of the present invention should not be restricted by the specific configuration illustrated in the drawings.

First, referring to FIGS. 1 and 3, a golf swing correction apparatus 100 using the moment of inertia of the present invention may comprise a correction apparatus protector 102 for receiving a weight to induce a rotational movement while wrapped around an elbow during a golf swing, a swing correction weight member 104 received and installed in the correction apparatus protector 102 for straightening the elbow, for maintaining the turn of the shoulders and rotation, and for turning using the reaction and centrifugal force during a swing, and the correction apparatus protector 102.

In more detail, a protector body 10 being wrapped around an elbow is formed and body wings 12 and 13 are formed on the left and right sides of the protector body 10, in the golf swing correction apparatus 100 using the moment of inertia.

It is preferable that a swing correction weight member 104 is received in the body 10.

It is preferable that connection fixing means 106 is installed on the body wings 12 and 13.

A receiving unit 14 is formed on an upper part or a rear part of the body 10. The receiving unit 14 is preferably formed in an elongated shape to receive the swing correction weight member 104.

The connection fixing means 106 are installed and fixed on the body wings 12 and 13 formed on one side of the body 10, and the connection fixing means 106 consists of a plurality of fixing rings 16 fixed on the body wing 12 and a plurality of fixing bands 18 which are fixed on the body wing 13 and fixed by insertion into the corresponding fixing rings 16.

Subsequently, a swing correction weight member 104 is received and installed in the receiving unit 14 of the body 10, and it is preferable that the swing correction weight member 104 is formed to be wrapped around the arm to distribute weight applied to the arm during a back-swing to induce a natural shoulder turn and to restrict the inward or outward rotating movement of the arm or bending of the elbow as a whole during a swing motion.

The body 10 is preferably made of mesh material through which sweat is released well and through which air easily goes through.

In the swing correction weight member 104, weights of the upper part and lower part are distributed unevenly, in which the ratio of the length (A) of the upper part to the length (B) of the lower part may be 2:1 or 3:1.

At this time, the weight of the upper part of length (A) can be 0.5 kg, and that of the lower part of length (B) can be 1.5 kg. These are only exemplary values of an embodiment of the present invention, and it is apparent that various modifications are possible.

The swing correction weight member 104 is preferably made of a base weight member 20 and a centrifugal weight member 22.

The base weight member 20 has an arch shape for naturally covering the arm, and the centrifugal weight member 22 is formed on the extended lower part of the base weight member 20.

On both sides of the centrifugal weight member 22 are formed wing portions 23 extended in left and right sides, and the wing portions 23 are combined to the body wings 12 and 13 to stably hold the wrist and to fix the swing correction weight member 104 so that it cannot be taken off easily.

The swing correction weight member 104 formed as described above improves the turn of the shoulders by concentrating an energy of the moment of inertia of the improved swing using a weight member on the shoulder which is the connecting part of the body and the restricted arm during a swing and further enhancing calking ability by moving the swing energy to the wrist in which the connecting part of the restricted arm and the hand.

That is, by the correction apparatus protector 102 in which a weight member is added, the arm is covered such that the bending movement of the elbow or the inward or outward rotating movement of the arm is restricted as a whole, which improves the shoulder turn and wrist calking during a back-swing.

The above-described swing correction weight member 104 is preferably made of steel to distribute weight; however, hard or soft materials of synthetic resins, rubber, silicon, etc. having weight can be used as well.

FIG. 3 is a sectional view of the present invention which shows the state that the swing correction weight member 104 is received in the receiving unit 14 of the body 10.

Referring to FIG. 4, an embodiment of the present invention is described. The swing correction weight member 108 consists of a base weight member 24 and a centrifugal weight member 26 formed to be extended from the lower part of the base weight member 24.

An insertion receiving unit 28 is formed in the centrifugal weight member 26.

An adjustment weight 30 can be received and installed in the insertion receiving unit 28.

The adjustment weight member 30 can be inserted into the centrifugal weight member 26 to adjust various weight distributions. That is, the weight adjustment weight member 30 may weigh 0.1 kg-2.0 kg, and it is inserted to allow a user to select a variety of a proper weight and swing pattern.

This is to induce a natural swing according to the weight the user is feeling and to protect the arm and the shoulder when the user cannot stand the weight of the load due to an excessive swing.

In addition, it is to prevent the size (arc) of the swing from decreasing by bending the preceding (left) elbow burdened by the weight of the club of the reaction during a swing motion of golf club, to distribute the weight to the upper and lower part differently, in which more weight is distributed to the lower part of the elbow farther away from the rotating axis during a swing, which maximizes the moment of inertia to perform a shoulder turn. That is, more weight is applied to the hand and wrist portions than the shoulder portion to shoulder turn while maximizing the size of the swing arc with the elbow straightened.

For example, a half of the total weight of the swing correction weight member 104 can be distributed and applied on a ¼ position to the wrist side of the correction apparatus protector 102.

Furthermore, either a weight member band filled with sand or a weight member band filled with steel power to surround the wrist may be preferably formed on the wrist side of the protector body 10 of the correction apparatus protector 102.

The weight member band is preferably a band shape of one or at least two surrounding the wrist with a specific width.

FIG. 5 shows a state that the swing correction weight member 108 is received in the receiving unit 14 of the correction apparatus protector 102 of the present invention, wherein a weight adjustment weight member 30 is inserted and received in the swing correction weight member 108.

FIG. 6 shows another embodiment of the present invention, wherein a base weight member 24 is formed in the swing correction weight member 110, a centrifugal weight member 26 is formed which is extended from a lower part of the base weight member 24, a reception fixing unit 32 is formed in the centrifugal weight member 26, and a fixing groove 34 is formed on one side of an inner portion of the reception fixing unit 32.

A weight adjustment weight member 36 is inserted and fixed in the reception fixing unit 32.

At this time, a fixing protrusion 38 is formed on one side of the weight adjustment weight member 36, and the fixing protrusion 38 is inserted to the fixing groove 34 to be received.

In the meantime, a slanted coupling sill 33 is formed on an inner edge of one side of the reception fixing unit 32, and the weight adjustment weight member 36 preferably slides to be coupled smoothly.

Referring to FIGS. 7 and 8, it is shown that the swing correction weight member 110 is received and coupled in the receiving unit 14 of the correction apparatus protector 102, and the weight adjustment weight member 36 is inserted and coupled in the reception fixing unit 32 of the swing correction weight member 110.

FIG. 9 is another embodiment of the present invention, which shows that an attachment means 112 such as Velcro etc. is fixed on an upper surface or a lower surface of the swing correction weight member 104, and the upper and lower surfaces of the swing correction weight member 104 can be attached using the attachment means 112.

It provides a good compatibility by providing and combining a variety of weights depending on the users using freely detachable attachment means 112 as described above.

FIG. 10 is a use state perspective view showing a user swinging with the correction apparatus protector 102 in which a swing correction weight member 104 of the present invention is inserted wearing on a wrist, which shows that the arc of the turning reaction distance (C) is sufficiently achieved while the elbow is not bent and the radius of gyration is maximized by directing the weight of the swing correction weight member 104 to the wrist side from a back-swing through a down-swing to reach a half-swing.

Also, during a swing from an impact moment to a full follow-through, the arc of the swing turning reaction distance C) is sufficiently achieved while the elbow is not bent and the radius of gyration is maximized.

As described above, the present invention may be variously implemented by fixing the weight member for generating the moment of inertia to the protector body 10 using various attachment means or fixing means such as Velcro and the like or by sewing the weight member band filled with sand or steel powder onto the protection body 10.

The above detailed description is for the purpose of giving merely an illustrative explanation of the technical idea of the present invention, and various changes, modifications, and substitutions may be made to the invention by those skilled in the art pertinent to the present invention without departing from the essential features of the present invention. Accordingly, the embodiments and accompanying drawings disclosed in the present invention are only to illustrate the technical idea of the present invention and the scope of the technical idea of the present invention is not limited by the embodiments and accompanying drawings. The scope of the present invention should be interpreted by the appended claims, and all the technical ideas which fall within the equivalent scope should be interpreted to be included in the scope of the present invention.

What is claimed is:

1. A golf swing correction apparatus using a moment of inertia for extending a swing motion in golf which comprises:

a correction apparatus protector (102) for allowing an elbow to be outstretched without being bent, which includes a protector body (10) having a receiving unit (14) formed inside;

a swing correction weight member (104) which is received in the receiving unit (14) of the correction apparatus protector (102) for stretching a swing arc by increasing the weight in the direction of a wrist during a swing motion to direct the weight to the outside of the radius of gyration during a turning motion of the arms and shoulders for a swing; and a connection fixing means (106) for wrapping and fixing the elbow when the correction apparatus protector (102) is worn on an arm, wherein the swing correction weight member (104) includes a base weight member (20) and a centrifugal weight member (22), and wherein the centrifugal weight member extends from the base weight member in a longitudinal direction of the swing correction weight member such that the centrifugal weight member is shorter than the base weight member, and the centrifugal weight member is heavier than base weight member.

2. The golf swing correction apparatus using the moment of inertia of claim 1, wherein:

an insertion receiving unit (28) is formed inside of a lower part of the swing correction weight member; and a weight adjustment weight member (30) is equipped in the insertion receiving unit (28).

3. The golf swing correction apparatus using the moment of inertia of claim 1, wherein:

Velcro straps are attached on an upper side and a lower side of the swing correction weight member; and the swing correction weight members has a first portion and a second portion that have different sizes from each other that are respectively attached to the Velcro straps formed on the upper side and the lower side.

4. The golf swing correction apparatus using the moment of inertia of claim 1, wherein a weight member band filled with sand or a weight member band filled with steel powder is formed on the protector body (10) for wrapping a wrist.

5. The golf swing correction apparatus using the moment of inertia of claim 1, a ratio of the centrifugal weight member to the base weight member is 2:1 or 3:1.

6. A golf swing correction apparatus using a moment of inertia for extending a swing motion in golf which comprises:

a correction apparatus protector (102) for allowing an elbow to be outstretched without being bent, which includes a protector body (10) having a receiving unit (14) formed inside;

a swing correction weight member (104) which is received in the receiving unit (14) of the correction apparatus protector (102) for stretching a swing arc by increasing the weight in the direction of a wrist during a swing motion to direct the weight to the outside of the radius of gyration during a turning motion of the arms and shoulders for a swing; and a connection fixing means (106) for wrapping and fixing the elbow when the correction apparatus protector (102) is worn on an arm, wherein the swing correction weight member (104) includes a base weight member (20) and a centrifugal weigh member (22), and the centrifugal weight member (22) is formed such that the centrifugal weight member is shorter than the base weight member, a reception fixing unit (32) having a fixing groove (34) is formed on an upper side of a lower part of the swing correction weight member; and a weight adjustment weight member (36) having a fixing protrusion (38) is inserted to be equipped in the reception fixing unit (32).

* * * * *